US009486664B2

(12) United States Patent
Prenatt

(10) Patent No.: US 9,486,664 B2
(45) Date of Patent: Nov. 8, 2016

(54) EXERCISE DEVICE

(71) Applicant: Jerry Prenatt, Pleasantville, PA (US)

(72) Inventor: Jerry Prenatt, Pleasantville, PA (US)

( * ) Notice: Subject to any disclaimer, the term of this patent is extended or adjusted under 35 U.S.C. 154(b) by 191 days.

(21) Appl. No.: 14/259,605

(22) Filed: Apr. 23, 2014

(65) Prior Publication Data

US 2015/0306444 A1 Oct. 29, 2015

(51) Int. Cl.

| | |
|---|---|
| ***A63B 21/072*** | (2006.01) |
| ***A63B 21/075*** | (2006.01) |
| ***A63B 21/008*** | (2006.01) |
| ***A63B 21/06*** | (2006.01) |

(52) U.S. Cl.

CPC ..... *A63B 21/0724* (2013.01); *A63B 21/0602* (2013.01)

(58) Field of Classification Search

CPC A63B 21/008; A63B 21/06; A63B 21/0602; A63B 21/0603; A63B 21/0604

See application file for complete search history.

(56) References Cited

U.S. PATENT DOCUMENTS

| | | | | |
|---|---|---|---|---|
| 405,128 | A * | 6/1889 | Stockburger | A63B 21/0724 482/106 |
| 702,356 | A | 6/1902 | Calvert | |
| 3,226,117 | A | 12/1965 | Walklet | |
| 3,231,270 | A | 1/1966 | Winer | |
| 3,579,859 | A | 5/1971 | Malenge | |
| 3,843,117 | A * | 10/1974 | Johnson | A63B 21/0602 482/110 |
| 4,029,312 | A | 6/1977 | Wright | |
| 4,076,236 | A | 2/1978 | Ionel | |
| 4,103,887 | A | 8/1978 | Shoofler | |
| 4,185,125 | A | 1/1980 | Sakakibara et al. | |
| 4,199,140 | A | 4/1980 | Ferretti | |
| 4,804,177 | A | 2/1989 | Rosson | |
| 5,203,753 | A | 4/1993 | Rothhammer | |
| 5,312,314 | A | 5/1994 | Stephan et al. | |
| 5,332,119 | A | 7/1994 | Davis | |
| 5,393,285 | A * | 2/1995 | Fischer, Sr. | A63B 21/0602 482/106 |
| 5,803,876 | A * | 9/1998 | Hickman | A63B 22/0076 482/100 |
| 5,839,996 | A * | 11/1998 | Gooding | A63B 21/072 482/106 |
| 5,842,956 | A | 12/1998 | Strachan | |
| 5,911,651 | A | 6/1999 | Liu | |
| 5,967,952 | A | 10/1999 | Bronstein et al. | |
| 5,997,442 | A | 12/1999 | Cordes | |

(Continued)

FOREIGN PATENT DOCUMENTS

| | | |
|---|---|---|
| CN | 201510679 | 6/2010 |
| CN | 201783128 | 4/2011 |

(Continued)

OTHER PUBLICATIONS http://www.alibaba.com/showroom/water-filled-dumbells.html taken on Oct. 31, 2013.

(Continued)

*Primary Examiner* — Oren Ginsberg
(74) *Attorney, Agent, or Firm* — Oliff PLC

(57) ABSTRACT

An exercise device includes a pair of hollow tubular members. Each hollow tubular member includes an outer tube, and a pair of end plates that seal respective ends of the outer tube, such that an enclosed space is defined within the outer tube. Removable plugs allow flowable material to be admitted into the enclosed spaces. A bar connects to the pair of hollow tubular members and holds the hollow tubular members in a spaced-apart state. When the enclosed spaces are partially filled with flowable material, a "slosh effect" occurs that exercises certain muscles or muscle groups.

7 Claims, 7 Drawing Sheets

(56) References Cited

U.S. PATENT DOCUMENTS

| | | | | |
|---|---|---|---|---|
| D563,490 | S | 3/2008 | Prenatt | |
| D584,161 | S | 1/2009 | Barker | |
| D594,524 | S | 6/2009 | Olivia | |
| 7,758,477 | B2 | 7/2010 | Prenatt | |
| 7,785,239 | B2 | 8/2010 | Daniel | |
| 7,798,944 | B2 | 9/2010 | Suber et al. | |
| D628,250 | S | 11/2010 | Januszek | |
| 7,922,633 | B2 | 4/2011 | Januszek | |
| 8,337,372 | B1 * | 12/2012 | Boterenbrood ..... | A01B 1/02 294/49 |
| D692,970 | S | 11/2013 | Lien | |
| D697,148 | S | 1/2014 | Lin | |
| D708,485 | S | 7/2014 | VanDyke | |
| 2005/0065001 | A1 | 3/2005 | Su | |
| 2008/0214368 | A1 | 9/2008 | Cao | |
| 2009/0176635 | A1 | 7/2009 | Brinson | |
| 2010/0222186 | A1 | 9/2010 | Grand | |
| 2011/0230317 | A9 | 9/2011 | Barber | |
| 2014/0243169 | A1 | 8/2014 | Justice | |

FOREIGN PATENT DOCUMENTS

| | | |
|---|---|---|
| GB | 2 046 601 | 11/1980 |
| WO | WO 01/83039 | 11/2001 |
| WO | WO 2005/075027 | 8/2005 |

OTHER PUBLICATIONS

Aug. 27, 2015 Office Action issued in U.S. Appl. No. 29/488,822.
Jan. 14, 2016 Notice of Allowance issued in U.S. Appl. No. 29/488,822.

* cited by examiner

EXERCISE DEVICE

BACKGROUND

This invention relates to an exercise device usable for strength training, endurance training, physical rehabilitation, or the like.

Weight lifting equipment has long been used for strength training, endurance training and physical rehabilitation. Traditional weight lifting equipment is in the form of "free weights," including barbells and the like on which weight disks are mounted, or "machine weights," in which stacks of weights slide on bars or guide tracks and are attached to various lifting bars and/or cables via which users lift the stacked weights through various lifts such as the bench press, military press, curls, leg presses, and so forth.

Many weights used in free weight assemblies are manufactured in hollow disks or special hollow shapes, and then filled with water, concrete, sand or other material to add weight. Plastic has been chosen as the material for these hollow shapes, for various reasons such as portability (e.g., the ability to be emptied, carried to a different location in one's luggage or the like, and then refilled for use) and the ability of plastic to be formed into complex shapes relatively easily (e.g., through plastic molding or the like). Metal is also a popular alternative for free weights, but metal weights have been provided in solid disks.

SUMMARY

This invention provides an exercise device in which hollow tubular members are attached to respective ends of a bar. The hollow tubular members may be partially filled with flowable material such as sand, water or the like, which provides a "slosh effect" when the bar undergoes certain motions.

BRIEF DESCRIPTION OF THE DRAWINGS

Exemplary embodiments will be described with reference to the accompanying drawings, in which like numerals represent like parts, and wherein.

DETAILED DESCRIPTION OF EMBODIMENTS

Figure 1:
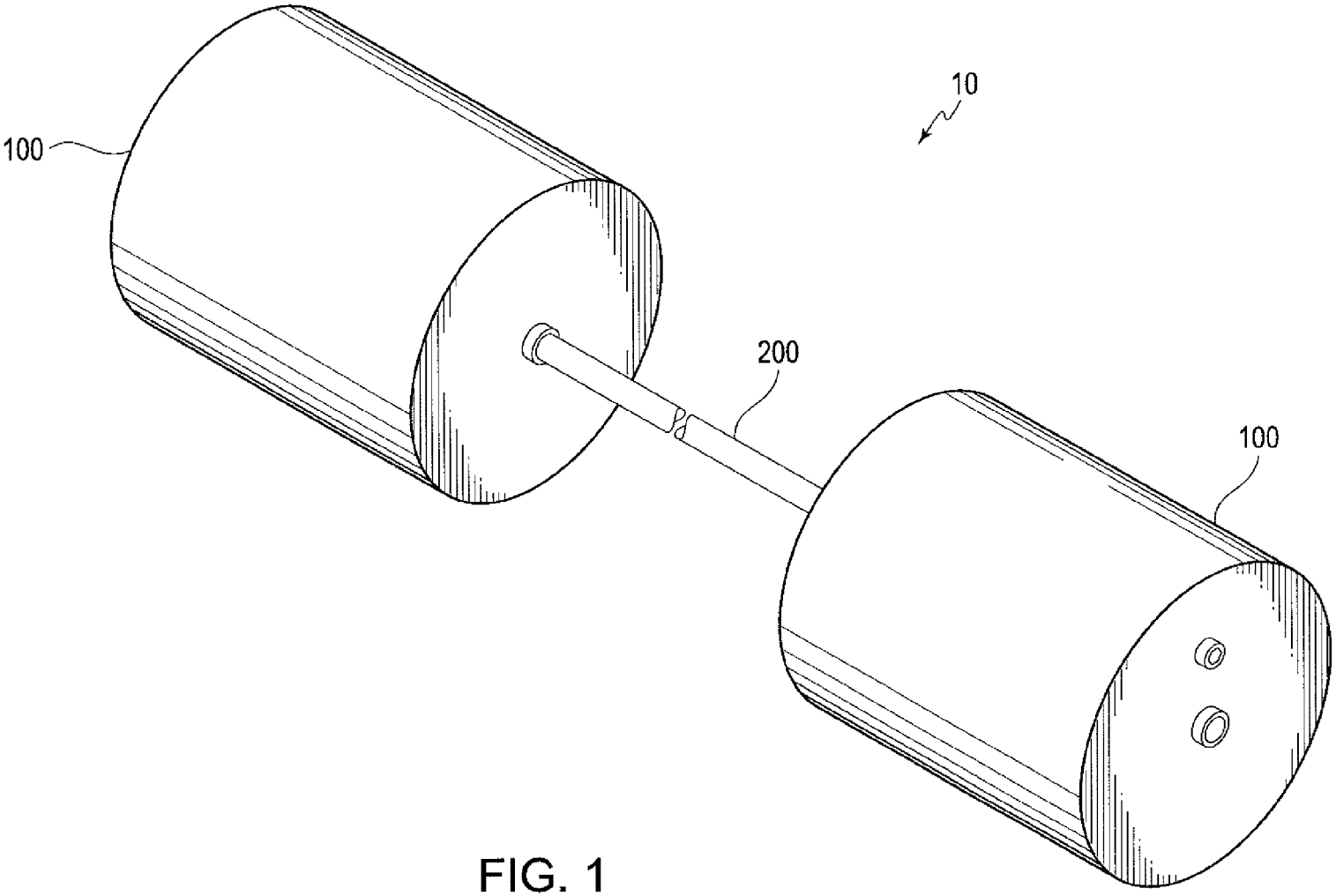
FIG. 1 is a perspective view of a first embodiment of an exercise device.

FIG. 1 is a perspective view of an exercise device 10 according to an exemplary embodiment of the invention. The exercise device 10 includes a pair of hollow tubular members 100 that attach to a bar 200. The bar may be a relatively long bar, such as is commonly used for lifts such as bench presses, military presses, or the like, or may be a relatively short bar such as is commonly used for dumbbell lifts with a single hand.

Figure 2:
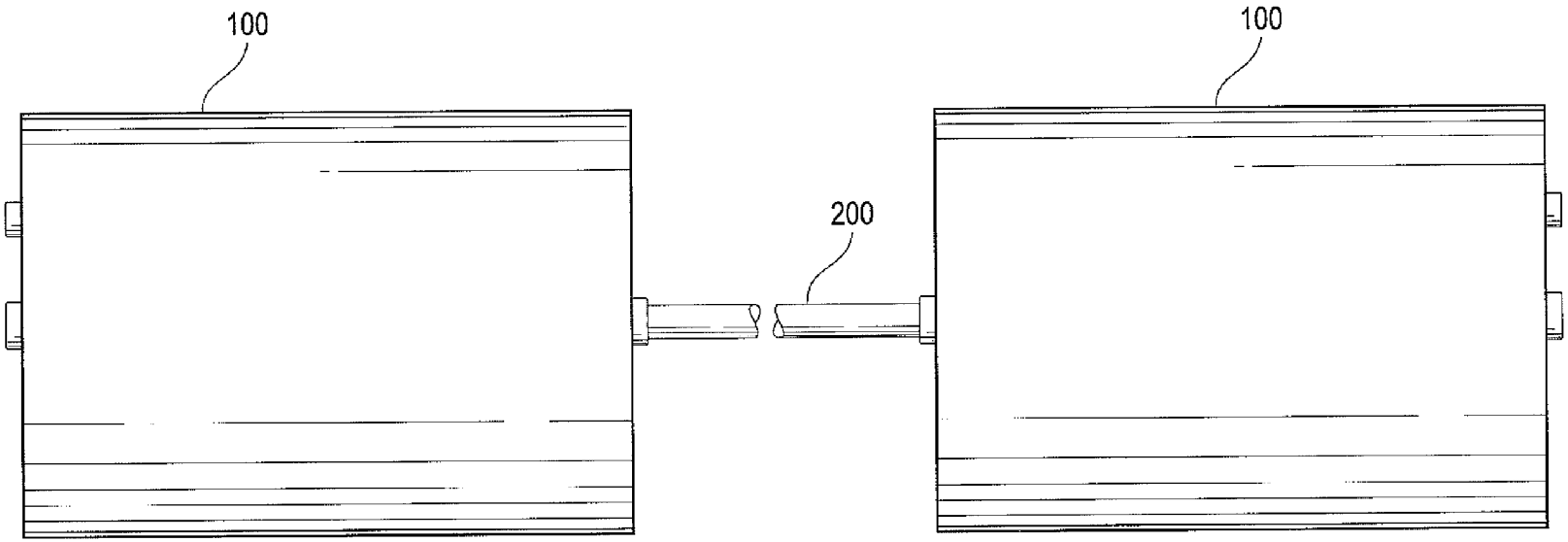
FIG. 2 is a front elevation view of the exercise device of FIG. 1.
Figure 3:
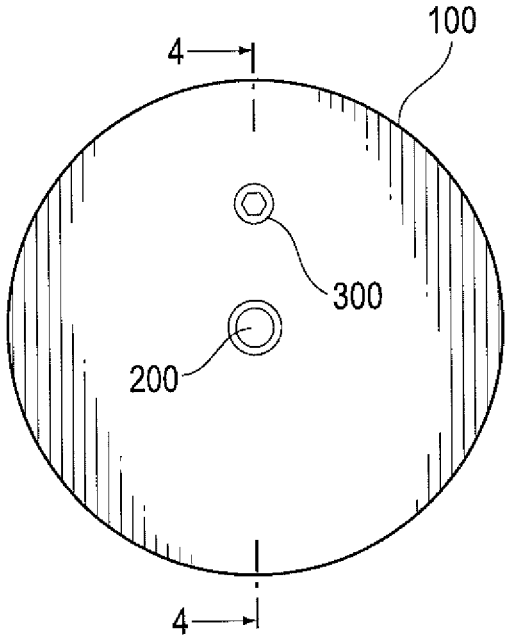
FIG. 3 is a right side elevation view of the exercise device of FIG. 1.

FIG. 2 is a front view of the exercise device 10, and FIG. 3 is a side view that shows an end surface of one of the hollow tubular members 100.

Figure 4:
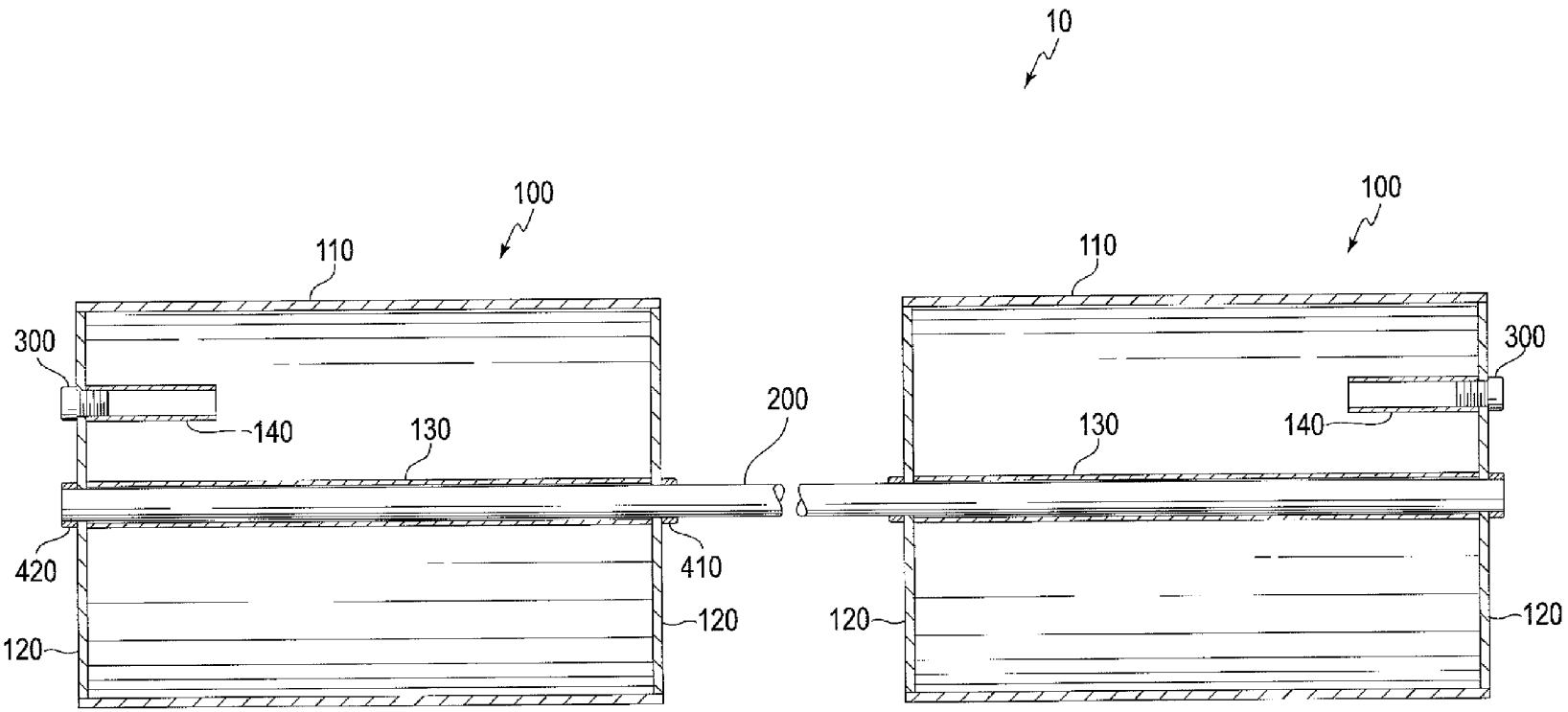
FIG. 4 is a cross-sectional view taken along line 4-4 of FIG. 3.

FIG. 4 is a cross-sectional view taken along line 4-4 of FIG. 3. As depicted, each hollow tubular member 100 includes an outer tube 110, and end plates 120 that seal opposite ends of the outer tube 110. The end plates 120 may be joined to the outer tube 110 by welding or any other suitable method. The hollow tubular members 100 may be made of carbon steel, aluminum, stainless steel, or any other suitable material. Metal material such as carbon steel, aluminum or stainless steel is advantageous in terms of withstanding the "slosh effect," described hereafter. The thickness of the material of the hollow tubular members may be, for example, about 1/8 inch, about 3/16 inch, about 1/4 inch, about 5/16 inch, about 3/8 inch, or about 1/12 inch. Conventional plastic weights are not designed to withstand the slosh effect, and have the potential to break when repeatedly subjected to the slosh effect.

Each hollow tubular member 100 may have any desired width or diameter, and any desired length. For example, the nominal diameter of the hollow tubular member 100 may be 4 inches, 6 inches, 8 inches, 10 inches, 12 inches, 14 inches or 16 inches. The length of the hollow tubular member 100 may be, for example, about 6 inches, about 8 inches, about 10 inches, about 12 inches, about 14 inches, about 16 inches about 18 inches, about 20 inches, about 22 inches, or about 24 inches. The length-to-diameter ratio of each tubular member may be, for example, about 0.5:1, about 0.75:1, about 1:1, about 1.25:1, about 1.5:1, about 1.75:1, about 2:1; about 2.25:1, about 2.5:1, about 2.75:1, about 3:1, about 3.25:1, about 3.5:1, about 3.75:1, or about 4:1. A length-to-diameter ratio of smaller than about 0.5:1 may not provide a very noticeable slosh effect, and a length-to-diameter ratio of larger than about 4:1 may result in an exercise device that is somewhat unwieldy and/or in which the timing of the slosh effect becomes undesirable.

Each hollow tubular member 100 may also include an inner tube 130 connected to the pair of end plates 120, such that an enclosed space is defined between the inner tube 120, the outer tube 110 and the end plates 120. Each inner tube 130 may be sized to fit over an end of the bar 200. Fixed inner collars 410 and removable outer securing devices 420, such as conventional locking collars, spring clamps or the like, may be provided to secure the hollow tubular members 100 to respective ends of the bar 200. Other ways of attaching the hollow tubular members 100 to the bar 200 are also possible, such as (i) providing flanges (not shown) at the ends of the bar 200 and then bolting or welding the hollow tubular members 100 to the flanges, or (ii) welding the hollow tubular members 100 directly to the ends of the bar 200. In such cases, the inner tubes 130 may be omitted.

A removable plug 300 may be provided in each hollow tubular member 100, such as in one of the end plates 120 or in the outer tube 110. The plugs 300 can be, for example, threaded plugs that thread into respective pipe fittings attached to the hollow tubular members 100. The plugs 300 can be removed to allow admission of flowable material into the hollow tubular members 100 to increase the weight of the exercise device 10, and/or to allow removal of the flowable material. However, in some embodiments, permanently attachable, non-removable plugs may be used to permanently seal a fixed amount of flowable material in each hollow tubular member 100. The flowable material may be, for example, water, sand or the like.

The hollow tubular members 100 may be completely filled with flowable material, for maximum weight. Alternatively, the hollow tubular members 100 may be partially filled, to result in any desired weight between the empty weight and full weight of the exercise device 10. When the hollow tubular members 100 are filled partially, a "slosh effect" can be achieved by rotating the bar 200 about an axis perpendicular to its longitudinal axis, causing the flowable material in each hollow tubular member 100 to shift toward an end of the hollow tubular member 100 due to gravity and/or centrifugal acceleration. This can have the beneficial effect of exercising certain muscles or muscle groups that may otherwise be difficult to exercise.

To ensure that each hollow tubular member 100 is only partially filled, a tube 140 may be connected to and protrude inward from an end plate 120 or the outer tube 110, in communication with the fill hole that is stopped by the plug 300. The tube 140 may extend into the interior of the hollow tubular member 100, and may have a length of, for example, about 25% of the length of the hollow tubular member 100. When the hollow tubular member 100 is positioned with the fill hole facing upward, and flowable material is caused to flow into the hollow tubular member 100, the tube 140 restricts further entry of flowable material when the level of flowable material reaches the bottom of the tube 140. The tubes 140 may be permanently attached to the hollow tubular members 100 by welding or any other suitable attachment method. Alternatively, the tubes 140 may be detachable, e.g., by being insertable through the fill hole from outside of the hollow tubular members 100, and then removable through the fill hole after entry of the flowable material. A plurality of such detachable fill tubes could be provided, each having a different length, for filling the hollow tubular members 100 to different levels.

Additional plugs, not depicted, may be provided in the hollow tubular members 100 as drain plugs. A dedicated drain plug in each hollow tubular member 100 is beneficial if the tubes 140 are provided, because otherwise it would be difficult to completely drain the hollow tubular members 100.

Figure 5:
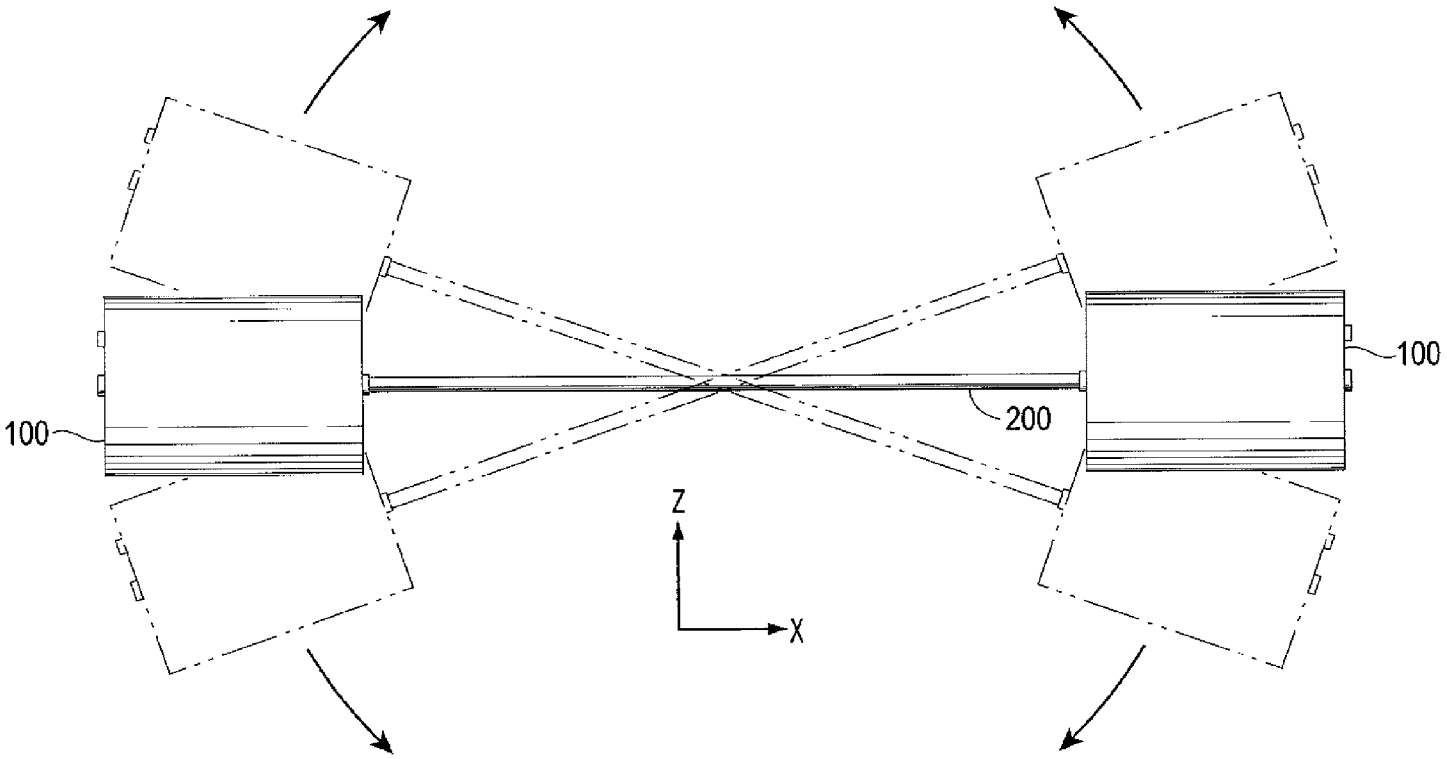
FIG. 5 illustrates a method of using an exercise device.
Figure 6:
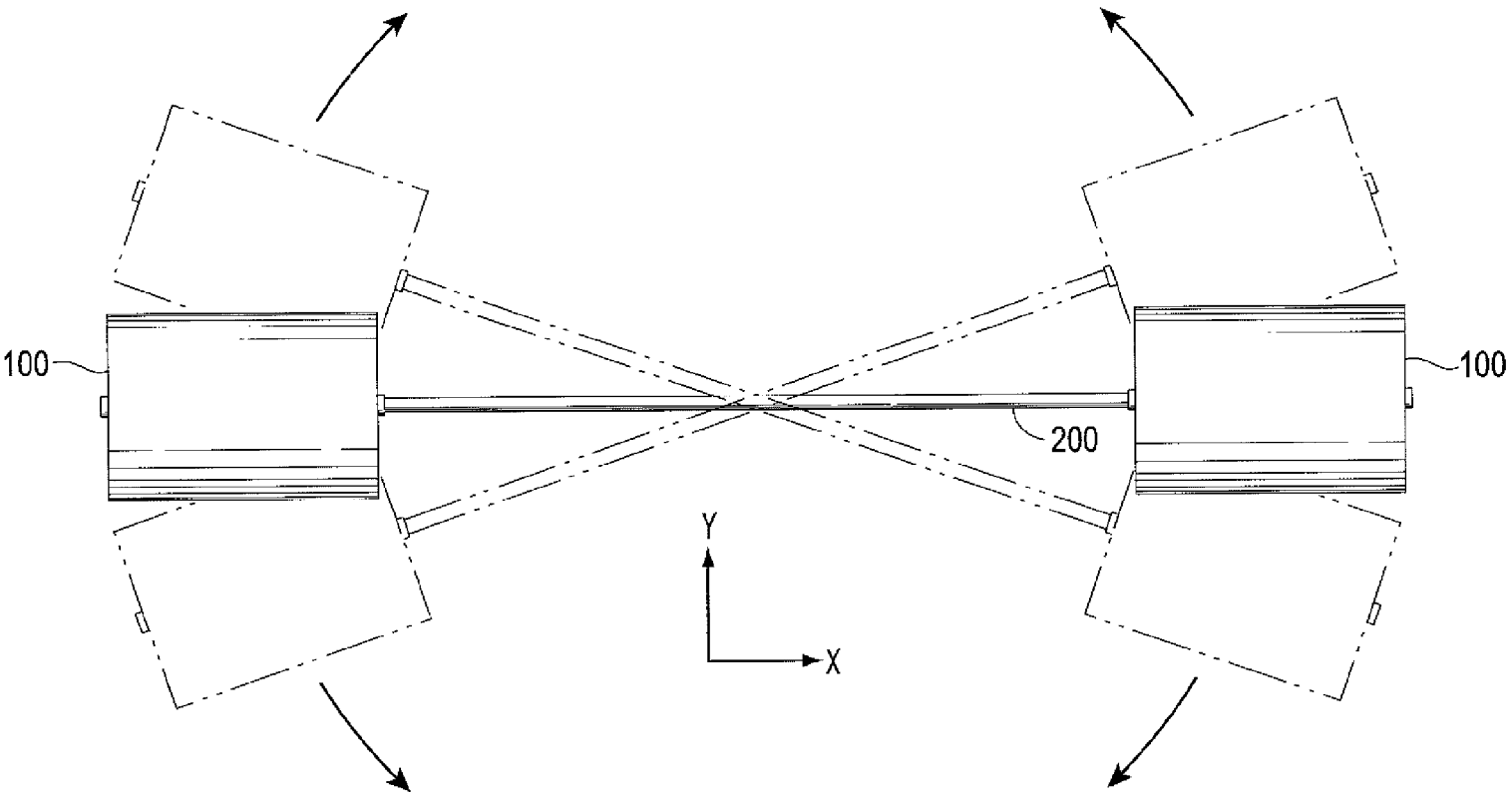
FIG. 6 illustrates another method of using an exercise device.
Figure 7:
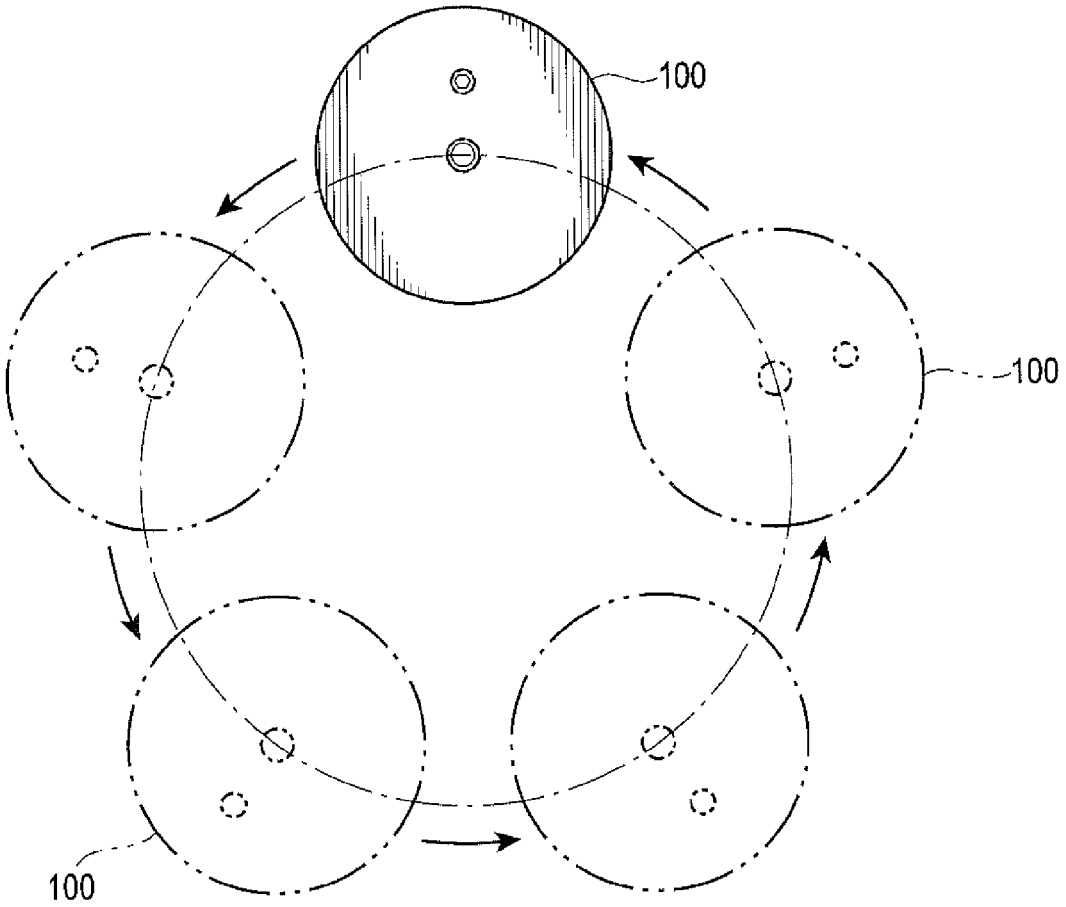
FIG. 7 illustrates another method of using an exercise device.

With the exercise device 10, a user may perform all of the traditional lifts that may be performed with a conventional bar and weight set. Additionally, a user may provide additional exercises that use the "slosh effect" described above. For example, a user may hold the bar 200 overhead while standing or lying down and (i) rotate the bar 200 back and forth in a vertical plane (e.g., the X-Z plane as shown in FIG. 5), (ii) rotate the bar 200 back and forth in a horizontal plane (e.g., the X-Y plane as shown in FIG. 6), or (iii) move his or her hands in a bicycle-pedaling motion, such that each hollow tubular member 100 moves in a circular motion (e.g., as shown in FIG. 7).

While the invention has been described in conjunction with specific embodiments, these embodiments should be viewed as illustrative and not limiting. Various changes, substitutes, improvements or the like are possible within the spirit and scope of the invention.

What is claimed is:

1. An exercise device, comprising:

a pair of hollow tubular members, made of metal material, each hollow tubular member comprising:

an outer tube;

a pair of end plates that seal respective ends of the outer tube, such that an enclosed space is defined within the outer tube; and a plug that is removable to allow admission of flowable material into the enclosed space, and attachable to seal the flowable material inside the enclosed space; and a bar that connects to the pair of hollow tubular members and holds the hollow tubular members in a spaced-apart state; and wherein a length of each hollow tubular member, in a direction parallel to the bar, is greater than a width of the respective hollow tubular member, in a direction perpendicular to the bar, and the enclosed space of each hollow tubular member has a maximum cross-sectional area at a longitudinally central portion of the respective hollow tubular member.

2. The exercise device of claim 1, wherein each hollow tubular member further comprises an inner tube connected to the pair of end plates, such that the enclosed space is defined between the inner tube, the outer tube and the end plates, the inner tube being sized to fit over the bar.

3. The exercise device of claim 1, further comprising flowable material that only partially fills the enclosed space of each hollow tubular member.

4. A method, comprising: performing a lift for strength training, endurance training or physical rehabilitation using the exercise device of claim 1.

5. The method of claim 4, wherein the lift comprises rotating the bar back and forth in a vertical plane.

6. The method of claim 4, wherein the lift comprises rotating the bar back and forth in a horizontal plane.

7. The method of claim 4, wherein the lift comprises a user's hands moving in a bicycle-pedaling motion while holding the bar, such that each hollow tubular member moves in a circular motion.

* * * * *